US009574766B2

(12) United States Patent
Brodesser et al.

(10) Patent No.: US 9,574,766 B2
(45) Date of Patent: Feb. 21, 2017

(54) ONCE-THROUGH STEAM GENERATOR

(71) Applicant: Siemens Aktiengesellschaft, Munich (DE)

(72) Inventors: Joachim Brodesser, Nuremberg (DE); Jan Brückner, Uttenreuth (DE); Martin Effert, Erlangen (DE); Tobias Schulze, Erlangen (DE); Frank Thomas, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/909,585

(22) PCT Filed: Jul. 29, 2014

(86) PCT No.: PCT/EP2014/066220

§ 371 (c)(1),
(2) Date: Feb. 2, 2016

(87) PCT Pub. No.: WO2015/018686

PCT Pub. Date: Feb. 12, 2015

(65) Prior Publication Data

US 2016/0178190 A1 Jun. 23, 2016

(30) Foreign Application Priority Data

Aug. 6, 2013 (DE) ..... 10 2013 215 456

(51) Int. Cl.
*F22B 29/06* (2006.01)
*F22B 21/34* (2006.01)
*F22B 35/10* (2006.01)

(52) U.S. Cl.
CPC ..... *F22B 29/062* (2013.01); *F22B 21/34* (2013.01); *F22B 21/345* (2013.01); *F22B 35/10* (2013.01); *F22B 35/104* (2013.01); *F22B 35/108* (2013.01)

(58) Field of Classification Search
CPC ..... F22B 29/062; F22B 29/06
(Continued)

(56) References Cited

U.S. PATENT DOCUMENTS 3,172,396 A * 3/1965 Kane ..... F22B 29/062 122/406.4
3,192,908 A 7/1965 Schroedter et al.
(Continued)

FOREIGN PATENT DOCUMENTS

CN 1155326 A 7/1997
CN 1239540 A 12/1999
(Continued)

OTHER PUBLICATIONS

CN Office Action dated Sep. 28, 2016, for CN application No. 201480044832.1.

*Primary Examiner* — Gregory A Wilson
(74) *Attorney, Agent, or Firm* — Beusse Wolter Sanks & Maire

(57) ABSTRACT

A once-through steam generator includes a combustion chamber, the walls of which comprise vertically arranged evaporator pipes connected to one another in gas-tight fashion by pipe webs, through which evaporator pipes flows a flow medium from bottom to top. The evaporator pipes are combined by upstream inlet collectors to form more intensely and less intensely heated pipe groups. A feed water supply is assigned to respective inlet collectors. At least one regulating valve regulates throttling of the mass flow of the flow medium into the evaporator pipes. To determine a control variable for the regulating valve, temperature measurement device measures outlet temperatures of the flow medium exiting the evaporator pipes. Each of the more intensely and less intensely heated pipe groups is assigned to
(Continued)

one of the inlet collectors and to an outlet collector, and each of the outlet collectors has one of the temperature measurement devices.

10 Claims, 2 Drawing Sheets

(58) Field of Classification Search
USPC ..... 122/511, 1 B, 406.4, 235.29, 235.15, 512,122/235.14
See application file for complete search history.

(56) References Cited

U.S. PATENT DOCUMENTS

| | | | | | |
|---|---|---|---|---|---|
| 3,297,004 | A * | 1/1967 | Midtlyng | F22B 29/026 | 122/406.4 |
| 3,344,777 | A * | 10/1967 | Gorzegno | F22B 29/062 | 122/406.4 |
| 3,548,788 | A * | 12/1970 | Altman | F22B 29/067 | 122/406.4 |
| 3,818,872 | A | 6/1974 | Clayton et al. | | |
| 4,178,881 | A * | 12/1979 | Pratt | F22B 37/125 | 122/235.12 |
| 4,290,389 | A | 9/1981 | Palchik | | |
| 4,473,035 | A * | 9/1984 | Gorzegno | F22B 29/065 | 122/235.12 |
| 5,560,322 | A * | 10/1996 | Fitzgerald | F22B 29/065 | 122/235.11 |
| 5,979,370 | A * | 11/1999 | Franke | F22B 29/062 | 122/235.14 |
| 5,983,639 | A | 11/1999 | Kral et al. | | |
| 6,189,491 | B1 * | 2/2001 | Wittchow | F22B 1/1815 | 122/1 C |
| 7,958,853 | B2 * | 6/2011 | Ruchti | F22B 1/18 | 122/32 |
| 2002/0000208 | A1 | 1/2002 | Franke et al. | | |
| 2011/0239961 | A1 | 10/2011 | Bauver, II et al. | | |
| 2013/0205784 | A1 * | 8/2013 | Brodesser | F22B 21/34 | 60/670 |

FOREIGN PATENT DOCUMENTS

| | | | |
|---|---|---|---|
| CN | 1330751 | A | 1/2002 |
| CN | 102906498 | A | 1/2013 |
| CN | 103154611 | A | 6/2013 |
| DE | 2132454 | A1 | 1/1973 |
| DE | 2428381 | A1 | 1/1975 |
| DE | 4431185 | A1 | 3/1996 |
| DE | 19528438 | A1 | 2/1997 |
| DE | 19651678 | A1 | 6/1998 |
| DE | 102010038883 | A1 | 2/2012 |
| GB | 1374835 | A | 11/1974 |

* cited by examiner

ONCE-THROUGH STEAM GENERATOR

CROSS REFERENCE TO RELATED APPLICATIONS

This application is the US National Stage of International Application No. PCT/EP2014/066220 filed 29 Jul. 2014, and claims the benefit thereof. The International Application claims the benefit of German Application No. DE 102013215456.9 filed 6 Aug. 2013. All of the applications are incorporated by reference herein in their entirety.

FIELD OF INVENTION

The invention relates to a once-through steam and to a method for operating a once-through steam generator.

The invention relates specifically to once-through or forced-flow steam generators for power plant facilities, having a burning chamber of rectangular cross section, each burning chamber wall of which comprises substantially vertically arranged evaporator tubes which are connected to one another in a gastight manner via tube webs and can be flowed through by a flow medium from the bottom to the top. Here, the heating of said evaporator tubes which form the burning chamber walls leads to complete evaporation of the flow medium in one pass. Here, in principle, the evaporator tubes of the once-through steam generator can be arranged partially or over the entire length in a vertical or perpendicular and/or helical or spiral manner. Here, once-through steam generators can be designed as forced-flow steam generators, the flow of the flow medium being forced here by a feed pump.

BACKGROUND OF INVENTION

Essential advantages of a pure vertical evaporator tube concept are simple construction of the burning chamber suspension means, low manufacturing and assembly outlay and relatively great ease of maintenance. In comparison with a burning chamber wall with spiral tubes, the investment costs can be reduced considerably in this way. Owing to the design, however, the temperature imbalances of evaporator tube concepts of this type with perpendicular tubes are substantially greater in comparison with burning chambers with spiral tubes. Whereas the evaporator tubes in a spiral winding run through virtually all the heating zones of the burning chamber and a satisfactory heating equalization can therefore be achieved, the individual burning chamber tubes of the perpendicular tubes remain in the respective heating zone from the upstream evaporator inlet header to the downstream evaporator outlet header. Therefore, tubes in greatly heated burning chamber regions, for example in the vicinity of the burners or else in the middle wall region of burning chambers with a rectangular cross section, experience continuous additional heating over the entire tube length. Tubes in weakly heated burning chamber regions, in particular the corner wall tubes of the burning chamber with a rectangular cross section, experience less heating over the entire tube length in contrast. In designs with spiral evaporator tubes, the additional and lesser heating of individual tubes or tube groups lies in the low single-digit percent range. In the case of designs with perpendicular tubes, in contrast, considerably greater additional and lesser heating in relation to the mean heat absorption of an individual evaporator tube is known. Accordingly, the essential challenge in the case of burning chamber walls with perpendicular tubes lies in the ability to control said great heating imbalances between individual evaporator tubes.

A way of solving the above-described problem which is very effective and has already been disclosed in DE 4 431 185 A1 is a design of the perpendicular tubes according to what is known as the "low mass flux" design. In this approach, lowest possible mass flow densities which result in a positive throughput characteristic of the individual evaporator tubes are aimed for in the perpendicular tubes. Specifically, this means that tubes with more heating have a higher throughput and tubes with less heating have a lower throughput. Therefore, the occurrence of impermissibly high temperature imbalances can be counteracted effectively solely by way of a targeted application of the laws of physics. Since, however, the requirements with regard to the degree of efficiency of the facilities have risen constantly in the last years and therefore the live steam temperature and pressure have likewise increased continuously and, in addition, ever greater load ranges also have to be covered by way of the power plant facility, there is a necessity to further develop said "low mass flux" design.

The use of newly developed materials and the ability to manage them during processing and during operation of the power plant facility additionally make it necessary to reduce possible temperature imbalances still further.

It would be obvious to divide the mass flow distribution to individual burning chamber wall regions and therefore different groups of evaporator tubes and then to manipulate this in a targeted manner. Specifically, this means that wall regions with high heating are in particular to have comparatively great throughflow rates and wall regions with low heating are to have correspondingly lower throughflow rates. For this purpose, the burning chamber has to be divided into representative wall regions in order to take different heating zones into consideration. This takes place by way of a segmentation of the inlet and outlet headers. Here, each header segment is assigned to a wall region with the representative heating. In the inlet region, each header segment is provided with a dedicated feed water supply line. By way of the selection of a suitable geometric configuration of said supply lines, or by way of the installation of additional orifice plates in the region of said supply lines, the division of the entire feed water mass flow to the individual header segments can be performed in a targeted manner depending on the respective heating situation.

Supply lines or orifice plates which are adapted to one another geometrically have the decisive disadvantage, however, that their throttling action changes with the load. Therefore, the mass flow distribution in the evaporator and the associated temperature imbalances at the evaporator outlet can be optimized only for a defined load range owing to the system. Moreover, both the supply lines and the orifice plates can be designed in a targeted manner and adapted to one another only in the case of precise knowledge of the heat distribution over the burning chamber circumference. If the heat distribution which occurs then differs during operation of the power plant facility from the distribution which is used in the design calculations of the supply lines or orifice plates, the temperature imbalances can even rise in the most unfavorable case. The idea of further securing the design via the geometric adaptation of the supply lines with or without orifice plates is therefore even reversed in some circumstances.

SUMMARY OF INVENTION

It is therefore an object of the invention to provide an improved once-through steam generator and a corresponding method for operating a once-through steam generator of this type.

This object is achieved by way of a once-through steam generator and a method having the features of the independent claims.

An advantage of the present invention is that evaporator tubes of the burning chamber walls are combined in accordance with their degree of heating by inlet headers which are arranged upstream in each case to form more heated tube groups and less heated tube groups, and at least one control valve is provided in the region of the corresponding feed water supply for the controlled throttling of the mass flow of the feed water and therefore of the flow medium which flows through the evaporator tubes, and temperature measuring means for measuring outlet temperatures of the flow medium from the evaporator tubes are provided in the region of outlet headers which are arranged downstream in order to determine a control variable for the at least one control valve, temperature imbalances of a burning chamber with perpendicular tubes can thus be minimized effectively with low outlay in the entire load range of the power plant facility, even in the case of a virtually unchanged design of the once-through evaporator. In the most favorable case, only one additional control valve as control fitting and a corresponding control concept are to be provided for this purpose. Here, the method according to the invention for operating a once-through steam generator of this type provides that the feed water supply of the less heated tube groups is reduced by way of throttling of the at least one control valve to such an extent that the outlet temperatures of the more heated tube groups are equalized to those of the less heated tube groups or are at a similar level.

Each of the more heated tube groups and less heated tube groups are advantageously assigned in each case to one of the inlet headers and an outlet header, and each of the outlet headers has one of the temperature measuring means. Here, the temperature measuring means are advantageously installed in the lines which emanate from the outlet headers, since a mixing temperature is measured here.

Specifically in the case of substantially rectangular burning chambers which have pronounced less heated tube groups in the corner wall regions, it can be advantageous if each of the four corner wall regions has a dedicated feed water supply line with in each case one dedicated control valve. Further equalization of the temperature distribution at the outlet of the evaporator wall, having perpendicular tubes, of a once-through steam generator can be achieved by way of said upgrade which can also be carried out in a modular manner if required. Under these circumstances, it is even conceivable to equip the once-through steam generator with tubes in a complete pass from the inlet to the outlet, with the result that reversing headers which have been provided up to now can be dispensed with. The pressure equalization which is possibly required for the dynamic stability might be realized here by way of a far less expensive pressure equalization header.

Further advantageous developments of the once-through steam generator according to the invention or of the forced-flow once-through steam generator can be gathered from the further subclaims.

BRIEF DESCRIPTION OF THE DRAWINGS

The invention is now to be explained by way of example using the following figures, in which.

DETAILED DESCRIPTION OF INVENTION

The present invention is based on the concept of segmenting the mass flow distribution of the flow medium which flows through the evaporator tubes in a burning chamber 1 into more heated tube groups 10 and less heated tube groups 11 and to then manipulate their throughflow rates in a targeted manner. In specific terms, this means that wall regions with high heating should have comparatively great throughflow rates and wall regions with low heating should have correspondingly lower throughflow rates. For this purpose, as shown by way of example in FIG. 1 and FIG. 2, the complete burning chamber 1 is divided into representative wall regions E1 to E4 and M1 to M4 with different heating zones. This takes place here at least by way of segmenting of the evaporator tubes into tube groups 10 and 11 by means of inlet headers (not shown in greater detail) at the lower end of the (forced-flow) once-through steam generator.

Figure 1:
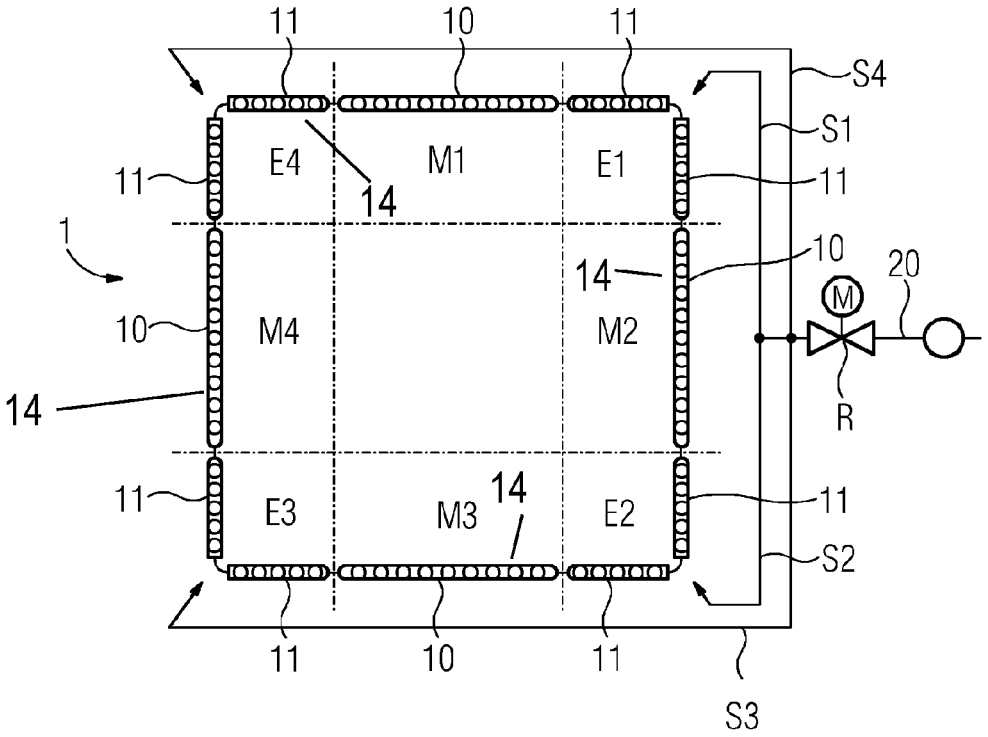
FIG. 1 diagrammatically shows a cross section of an embodiment according to the invention of a once-through steam generator with a rectangular burning chamber, FIG. 2 diagrammatically shows a second embodiment according to the invention, and FIG. 3 diagrammatically shows a top view of the embodiment of the once-through steam generator of FIG. 2.

In the cross section (shown diagrammatically in FIG. 1) through the once-through steam generator of the burning chamber 1, twelve segmented tube groups 10 and 11 can be seen. Here, each burning chamber wall is assigned two inlet header segments at the corners and an inlet header segment which lies in between. Here, each of the inlet header segments is assigned to a wall region with representative heating, the less heated corner wall regions E1 to E4 and the more heated middle wall regions M1 to M4 here, the corner wall regions E1 to E4 being assigned in each case two inlet header segments at the corner of two adjacent burning chamber walls. Here, each corner wall region E1 to E4 is assigned a feed water supply line S1 to S4 for supplying feed water to the corresponding inlet headers (14). Here, as shown in FIG. 1, they can branch off correspondingly from a feed water main supply line 20 and can supply in each case two tube groups of adjacent burning chamber walls in each corner wall region via the corresponding inlet header segments with feed water (indicated by way of arrows in FIG. 1). Here, the feed water main supply line 20 and the feed water supply lines S1 to S4 form the feed water supply to the tube groups 11 of the corner wall regions. If a control valve R is then provided in the feed water main supply line 20, different loads and also design uncertainties in the assumed heat distribution to the individual corner wall regions E1 to E4 can be reacted to adequately, by the feed water mass flow which is supplied to the evaporator tubes of the tube groups 11 of the corner regions E1 to E4 being adapted to the current operating conditions by way of controlled opening or closing of the control valve R. FIG. 1 does not show the supply of the tube groups 10 of the middle wall regions M1 to M4 with feed water from the feed water main supply line 20.

By means of temperature measuring means which are provided in the region of outlet headers which are arranged downstream in order to measure the outlet temperatures of the flow medium, the feed water supply 20 of the less heated tube groups 11 can be reduced by way of throttling of the control valve R to such an extent that the outlet temperatures of the less heated tube groups 11 are equalized to those of the more heated tube groups 10, and therefore the entire temperature profile at the outlet of the once-through steam generator is homogenized. Impermissibly high temperature imbalances can be prevented effectively and without great outlay in this way, since wall regions with low heat absorption then have lower throughflows and wall regions with great heat absorption have a high throughflow in a manner which is dependent on the measured temperatures.

Here, advantageously, at the evaporator outlet, the temperature measuring means of the more heated tube groups 10 from the middle wall regions can be combined as a "highly heated" system and the temperature measuring means of the less heated tube groups 11 from the corner wall regions can be combined as a "lowly heated" system. If the measured temperature of the system which is combined as "highly heated" is too great, the throughflow through the corner wall regions can be reduced by way of additional throttling of the control valve and the throughflow in the middle wall regions can be raised conversely, with the result that the mean temperature of the middle wall regions is lowered to the desired level.

In order to keep the additional costs and the outlay on control technology manageable or to limit them, the maximum number of individual header segments including associated control valves should be as limited as possible. Here, as shown in FIG. 1, the simplest system consists of only one additional control valve R in the feed water main supply line 20. It is assumed here that the four corner wall regions E1 to E4 of the burning chamber experience virtually the same heating among one another and can therefore be combined via the feed water supply lines S1 to S4 and the feed water main supply line 20 as a common tube group with a common feed water supply. In an analogous manner to this, the remaining wall middle regions M1 to M4 are also combined by way of a corresponding feed water supply (not shown in greater detail, however) to form a common tube group.

Figure 2:
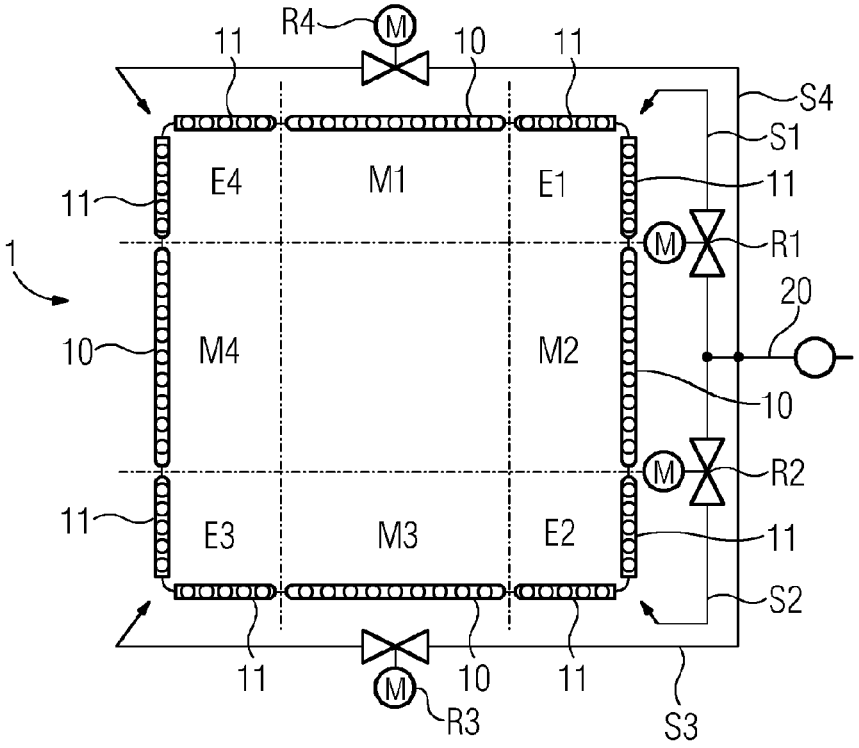
Figure 3:
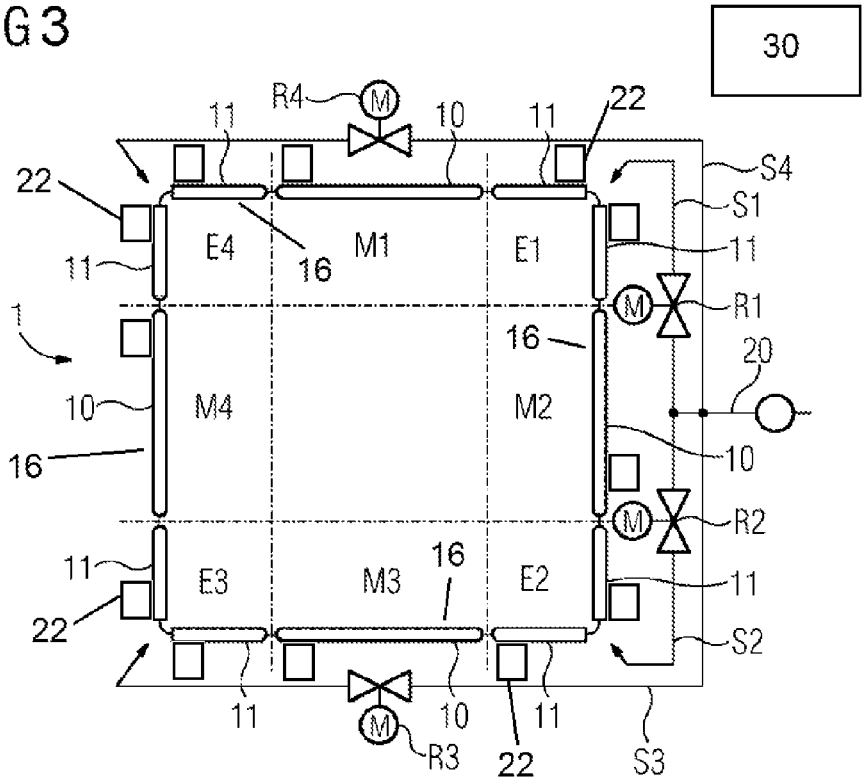

If imbalances between the individual corner wall regions E1 to E4 (and possibly additionally also between the individual middle wall regions M1 to M4) among one another are also to be taken into consideration and equalized, a minimum of four control valves R1 to R4 are to be installed in each of the feed water supply lines S1 to S4, as shown in FIGS. 2 and 3. That is to say, each corner wall region E1 to E4 can be supplied with feed water in an individually controlled manner independently of the other corner wall regions. Here, each of the four corner wall systems E1 to E4 advantageously has its own temperature measuring means. Depending on the temperature distribution of the flow medium at the outlet of the respective corner wall region, they are then together throttled individually in such a way that a relatively homogeneous outlet temperature profile is set over the entire wall circumference of the evaporator of the once-through steam generator. However, the outlay on control technology also rises here as expected with regard to the coordination of the individual control valves R1 to R4 among one another. In such an embodiment, there may be an outlet header 16 for each tube group 10, 11, a temperature measuring device 22 for each outlet header 16, and a controller 30 controlling the control valves R1 to R4 in response to information provided by the temperature measuring devices 22.

Combinations of the above-described exemplary embodiments and further additions are conceivable against the background of increasing requirements made of the flexibility during the operation of a power plant facility, and are also included in the invention. For instance, imbalances of the individual middle wall regions M1 to M4 among one another and in relation to the corner wall regions E1 to E4 can additionally also be taken into consideration and equalized if corresponding feed water supply lines and control valves for throttling said highly heated middle wall regions are provided. If dedicated control valves in the supply lines of the tube groups of the corner wall regions E1 to E4 were dispensed with at the same time, the throughflow through the corner wall regions could be limited in this special case in advance, for example by means of fixedly installed throttles, to such an extent that control of the feed water mass flow of the middle wall regions is made possible in the first place. It is only in said circumstances, in the case of a fully open control fitting in the supply lines of the highly heated middle wall systems, that their throughput would be so great that, despite higher heating, the middle wall systems would have lower outlet temperatures in comparison with the corner tube systems. By way of additional throttling of the control valves of the middle wall systems, the throughput through the middle wall systems which has then become too great might be reduced again, in order to homogenize the outlet temperatures of all systems.

In addition to the projected design of the once-through steam generator in order to compensate for temperature imbalances, faulty designs of the distributor system of the feed water supply can also be absorbed comfortably by way of the design according to the invention of the once-through steam generator and the method according to the invention. In addition, heating imbalances which were not taken into consideration during the design of the burning chamber can be handled reliably by way of the present invention without negative consequences. In addition, in some circumstances, fuel combinations can be used which were previously not possible, because heating imbalances can be reacted to flexibly. All in all, the present invention increases the uptime of the once-through steam generator and therefore of the entire power plant facility.

The invention claimed is:

1. A once-through steam generator, comprising:

a burning chamber of substantially rectangular cross section, the burning chamber walls of which comprise substantially vertically arranged evaporator tubes of the once-through steam generator which are connected to one another in a gastight manner via tube webs and are flowed through by a flow medium from the bottom to the top, wherein the evaporator tubes of the burning chamber walls are combined in accordance with their degree of heating by inlet headers which are arranged upstream in each case to form more heated tube groups and less heated tube groups, and wherein the respective inlet headers are assigned a feed water supply, at least one control valve provided in the region of the feed water supply for the controlled throttling of the mass flow of the flow medium in the evaporator tubes, temperature measuring devices for measuring outlet temperatures of the flow medium from the evaporator tubes located in the region of outlet headers which are arranged downstream in order to determine a control variable for the at least one control valve, wherein each of the more heated tube groups and less heated tube groups are assigned in each case to one of the inlet headers and an outlet header, wherein each of the outlet headers has one of the temperature measuring devices, and wherein the less heated tube groups being corner wall regions of the substantially rectangular burning chamber, and wherein each of the four corner wall regions has a dedicated feed water supply line with in each case one control valve, and a controller configured to reduce the feed water supply of the less heated tube groups by throttling of the at least one control valve to such an extent that outlet temperatures of the more heated tube groups are equalized to those of the less heated tube groups.

2. The once-through steam generator as claimed in claim 1, wherein the more heated tube groups are middle wall regions of the substantially rectangular burning chamber, and each of the four middle wall regions has a dedicated feed water supply with in each case one control valve.

3. The once-through steam generator as claimed in claim 1;

wherein the controller is further configured to reduce the feed water supply of the more heated tube groups by throttling of the at least one control valve to such an extent that the outlet temperatures of the more heated tube groups are equalized to those of the less heated tube groups.

4. The once-through steam generator as claimed in claim 1;

wherein the controller is further configured to establish an equalization of the outlet temperatures between the more heated and less heated tube groups.

5. The once-through steam generator as claimed in claim 1, wherein the once-through steam generator comprises a forced-flow steam generator.

6. A method, comprising:

operating a once-through steam generator comprising:

a burning chamber of substantially rectangular cross section, the burning chamber walls of which comprise substantially vertically arranged evaporator tubes of the once-through steam generator which are connected to one another in a gastight manner via tube webs and are flowed through by a flow medium from the bottom to the top, wherein the evaporator tubes of the burning chamber walls are combined in accordance with their degree of heating by inlet headers which are arranged upstream in each case to form more heated tube groups and less heated tube groups, and wherein the respective inlet headers are assigned a feed water supply;

at least one control valve provided in the region of the feed water supply for the controlled throttling of the mass flow of the flow medium in the evaporator tubes; and temperature measuring devices for measuring outlet temperatures of the flow medium from the evaporator tubes located in the region of outlet headers which are arranged downstream in order to determine a control variable for the at least one control valve;

wherein each of the more heated tube groups and less heated tube groups are assigned in each case to one of the inlet headers and an outlet header, wherein each of the outlet headers has one of the temperature measuring devices, and wherein the less heated tube groups being corner wall regions of the substantially rectangular burning chamber, and wherein each of the four corner wall regions has a dedicated feed water supply line with in each case one control valve; and reducing the feed water supply of the less heated tube groups by throttling of the at least one control valve to such an extent that outlet temperatures of the more heated tube groups are equalized to those of the less heated tube groups.

7. The method of claim 6, further comprising:

reducing the feed water supply of the more heated tube groups by throttling of the at least one control valve to such an extent that the outlet temperatures of the more heated tube groups are equalized to those of the less heated tube groups.

8. The method of claim 6, further comprising:

establishing an equalization of the outlet temperatures between the more heated and less heated tube groups.

9. A once-through steam generator, comprising:

a burning chamber of substantially rectangular cross section and comprising burning chamber walls which comprise substantially vertically arranged evaporator tubes connected to one another in a gastight manner via tube webs and which conduct a flow medium from the bottom to the top of the burning chamber, wherein the evaporator tubes are combined to form more heated tube groups in middle wall regions of the burning chamber and less heated tube groups in corner wall regions of the burning chamber;

a dedicated inlet header and a dedicated outlet header for each tube group;

a dedicated feedwater supply line in fluid communication with each inlet header of the less heated tube groups;

a control valve in the feedwater supply line for controlling a mass flow of the mass flow medium;

a temperature measuring device for measuring outlet temperatures of the flow medium;

a controller in signal communication with the temperature measuring device and the control valve and configured to control the mass flow rate of the flow medium in the dedicated feedwater supply line independent of a mass flow rate of the flow medium in the more heated tube groups in order to homogenize an outlet temperature of the flow medium of the less heated tube groups with an outlet temperature of the flow medium of the more heated tube groups.

10. The once-through steam generator of claim 9, further comprising:

a dedicated feedwater supply line for each corner region;

a dedicated control valve in each feedwater supply line; and a dedicated temperature measuring device for each outlet header;

wherein the controller is further configured to control the mass flow rate of the flow medium in each of the corner regions independent of the mass flow rate in other corner regions in order to homogenize an outlet temperature of the flow medium of the corner regions with an outlet temperature of the flow medium of the more heated tube groups.

* * * * *